US010578086B2

(12) United States Patent
Ventrapragada

(10) Patent No.: US 10,578,086 B2
(45) Date of Patent: Mar. 3, 2020

(54) CONNECTOR FOR A COMPRESSOR ASSEMBLY

(71) Applicant: KONINKLIJKE PHILIPS N.V., Eindhoven (NL)

(72) Inventor: Varaprasad Ventrapragada, Marietta, GA (US)

(73) Assignee: Koninklijke Philips N.V., Eindhoven (NL)

( * ) Notice: Subject to any disclaimer, the term of this patent is extended or adjusted under 35 U.S.C. 154(b) by 246 days.

(21) Appl. No.: 15/525,410

(22) PCT Filed: Oct. 20, 2015

(86) PCT No.: PCT/IB2015/058055
§ 371 (c)(1),
(2) Date: May 9, 2017

(87) PCT Pub. No.: WO2016/075569
PCT Pub. Date: May 19, 2016

(65) Prior Publication Data

US 2017/0335837 A1 Nov. 23, 2017

Related U.S. Application Data

(60) Provisional application No. 62/077,603, filed on Nov. 10, 2014.

(51) Int. Cl.
*F04B 27/00* (2006.01)
*F04B 39/12* (2006.01)
(Continued)

(52) U.S. Cl.
CPC ..... *F04B 27/005* (2013.01); *F04B 39/06* (2013.01); *F04B 39/121* (2013.01);
(Continued)

(58) Field of Classification Search
CPC ..... F04B 27/005; F04B 53/001; F04B 35/01; F04B 35/06; F04B 39/06; F04B 39/16;
(Continued)

(56) References Cited

U.S. PATENT DOCUMENTS 2,256,654 A 2/1937 Spurgeon
5,584,675 A * 12/1996 Steurer ..... F04B 39/066 417/372

(Continued)

FOREIGN PATENT DOCUMENTS

| | | | |
|---|---|---|---|
| BE | 539041 | | 7/1955 |
| DE | 102008014205 | A1 | 9/2009 |
| FR | 2931903 | A1 | 12/2009 |
| WO | WO2008028669 | A | 3/2008 |
| WO | WO2013091218 | A1 | 6/2013 |

*Primary Examiner* — Nathan C Zollinger
(74) *Attorney, Agent, or Firm* — Michael W. Haas

(57) ABSTRACT

A connector (24) and method of connecting a compressor assembly (10) that increases the pressure of a fluid are described. The compressor assembly (10) includes cylinders (12*a,b*), crank shaft housings (18*a,b*), and a motor housing (22). The connector (24) is disposed between the cylinders (12*a,b*) and the crank shaft housing (18*a,b*) and configured to engage the cylinders (12*a,b*) such that vibration during operation of the compressor assembly is reduced through the placement of the connector (24) corresponding to a center of gravity of the compressor assembly (10). The connector may also be used by the compressor assembly as a heat sink, inlet, mount, filter, and/or to provide other functions that improve the operation of compressor assembly.

15 Claims, 11 Drawing Sheets

(51) Int. Cl.

| | |
|---|---|
| ***F04B 41/06*** | (2006.01) |
| ***F04B 39/06*** | (2006.01) |
| ***F04B 35/04*** | (2006.01) |
| ***F04B 35/01*** | (2006.01) |
| ***F04B 39/00*** | (2006.01) |
| ***F04B 39/16*** | (2006.01) |
| ***F04B 53/00*** | (2006.01) |
| *F04B 35/06* | (2006.01) |

(52) U.S. Cl.
CPC ..... *F04B 39/123* (2013.01); *F04B 39/125* (2013.01); *F04B 41/06* (2013.01); *F04B 35/01* (2013.01); *F04B 35/04* (2013.01); *F04B 35/06* (2013.01); *F04B 39/0005* (2013.01); *F04B 39/0094* (2013.01); *F04B 39/16* (2013.01); *F04B 53/001* (2013.01)

(58) Field of Classification Search
CPC .... F04B 39/0094; F04B 39/121; F04B 41/06; F04B 39/123; F04B 39/125; F04B 39/127; F04B 39/12; F04B 35/04; F04B 17/03; F04B 53/16; F04B 53/162
See application file for complete search history.

(56) References Cited

U.S. PATENT DOCUMENTS

| | | | | |
|---|---|---|---|---|
| 6,056,521 | A * | 5/2000 | Leu | F04B 35/04 417/415 |
| 6,126,410 | A * | 10/2000 | Kung | F04B 39/0005 137/855 |
| 6,431,845 | B1 * | 8/2002 | Thomas | F04B 27/02 417/415 |
| D532,796 | S | 11/2006 | Leu | |
| 9,074,589 | B2 * | 7/2015 | Leu | F04B 35/04 |
| 9,422,928 | B2 * | 8/2016 | Ventrapragada | F04B 35/04 |
| 2005/0002805 | A1 * | 1/2005 | Fuksa | F04B 35/04 417/415 |
| 2006/0275160 | A1 * | 12/2006 | Leu | F04B 27/005 417/415 |
| 2007/0280838 | A1 * | 12/2007 | Otte | F04B 27/005 417/360 |
| 2009/0016917 | A1 | 1/2009 | Smits | |
| 2011/0070106 | A1 * | 3/2011 | Huang | F04B 27/005 417/338 |
| 2014/0147300 | A1 * | 5/2014 | Blackburn | F04B 39/122 417/312 |
| 2018/0291885 | A1 * | 10/2018 | Grybush | F04B 39/1066 |

* cited by examiner

CONNECTOR FOR A COMPRESSOR ASSEMBLY

CROSS-REFERENCE TO RELATED APPLICATIONS

This patent application claims the priority benefit under 35 U.S.C. § 371 of international patent application no. PCT/IB2015/058055, filed Oct. 20, 2015, which claims the priority benefit under 35 U.S.C. § 119(e) of U.S. Provisional Application No. 62/077,603 filed on Oct. 21, 2014, the contents of which are herein incorporated by reference.

BACKGROUND OF THE INVENTION

1. Field of the Invention

The present disclosure pertains to a connector coupled with a compressor assembly.

2. Description of the Related Art

Typically, a compressor receives a supply of fluid, such as a liquid or gas, at a first pressure and increases the pressure of the fluid by forcing a given quantity of the received fluid having a first volume into a smaller second volume using a piston assembly. Some compressors have a reciprocating piston that reciprocates within the cylinder to compress the fluid. The pistons may be connected to a crank shaft housed in a crank shaft housing. The crank shaft may be operated by a motor housed in a motor housing. A typical piston assembly includes a cup seal to provide a seal between the pressurized and non-pressurized sides of the piston. The cup seal flexes during movement of the piston within the cylinder and the frictional engagement creates wear along the cup seal. The pressurization of gas on the pressurized side of the piston, the frictional engagement of the cup seal with the cylinder, and/or other operating conditions generate heat to which the cup seal is exposed. This heat hastens failure of the flexible cup seal, thus limiting the life of the compressor.

In some compressors, heat may be dissipated from the cup seal using a crank shaft housing that is directly coupled to the cylinder. Because of its mass, the crank shaft housing may be intended to function as a heat sink to conduct the heat from the cylinder and the cup seal. Subsequently, a fan may provide air convection to dissipate the heat away from the crank shaft housing.

However, in compressors where the motor housing is directly coupled to the crank shaft housing, heat may be simultaneously conducted from the motor to the crank shaft housing when heat is conducted from the cup seal and the cylinder to the crank shaft housing. This is problematic when the thermal heat from the motor exceeds the heat being generated at or within the cylinder. In such situations, the heat from the motor may be indirectly conducted to the cylinder and the cup seal, thus ultimately increasing the heat on the cylinder and cup seal rather than decreasing it. Accordingly, further steps must be taken to remove heat from the cylinder/crank shaft housing/motor housing system. For example, a larger fan may be used to provide higher CFM (cubic feet per minute) of air to convect the heat. However, this may cause the device that includes such compressor and fan to be larger and bulkier. Alternatively and/or additionally, a larger crank shaft housing may be used. However, this may cause the compressor to be bulkier, more expensive to manufacture, and inefficient.

SUMMARY OF THE INVENTION

Accordingly, one or more aspects of the present disclosure relate to a compressor assembly configured to increase pressure of a fluid. The compressor assembly comprising: a first cylinder that forms a first space for compressing a fluid; a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder; a second crank shaft housed within the second crank shaft housing, the second crank shaft being configured to drive the second piston; a motor housing operatively coupled with the first crank shaft housing and the second crank shaft housing; a motor housed within the motor housing, the motor being configured to drive the first crank shaft and the second crank shaft; and a connector disposed between the first cylinder and the second cylinder, and outside of the first crank shaft housing, the second crank shaft housing, and the motor housing. The connector engages the first cylinder and the second cylinder and maintains the operative couplings between the first cylinder and the first crank shaft housing, the second cylinder and the second crank shaft housing, and the motor housing with the first crank shaft housing and the second crank shaft housing.

Yet another aspect of the present disclosure relates to a method for increasing the pressure of a fluid with a compressor assembly. The compressor assembly comprises a first cylinder that forms a first space for compressing a fluid, a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder; a second crank housed within the second crank shaft housing, the second crank shaft being configured to drive the second piston; a motor housing operatively coupled with the first crank shaft housing and the second crank shaft housing; and a motor housed within the motor housing, the motor being configured to drive the first crank shaft and the second crank shaft. The method comprises disposing a connector between the first cylinder and the second cylinder outside the first crank shaft housing, the second crank shaft housing, and the motor housing; engaging the first cylinder and the second cylinder with the connector; and maintaining the operative couplings between the first cylinder and the first crank shaft housing, the second cylinder and the second crank shaft housing, and the motor housing operatively coupled with the first crank shaft housing and the second crank shaft housing.

Still another aspect of present disclosure relates to a system to increase pressure of a fluid with a compressor assembly. The compressor assembly comprises a first cylinder that forms a first space for compressing a fluid, a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder; a second crank shaft housed within the second crank shaft housing, the second crank shaft being configured to drive the second piston; a motor housing operatively coupled with the first crank shaft housing and the second crank shaft housing; a motor housed within the motor housing, the motor being configured to drive the first crank shaft and the second crank shaft. The system comprising means for disposing a connector between the first cylinder and the second cylinder outside the first crank shaft housing, the second crank shaft housing, and the motor housing; means for engaging the first cylinder and the second cylinder with the connector; and means for maintaining the operative couplings between the first cylinder and the first crank shaft housing, the second cylinder and the second crank shaft housing, and the motor housing with the first crank shaft housing and the second crank shaft housing.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION OF EXEMPLARY EMBODIMENTS

Figure 1A:
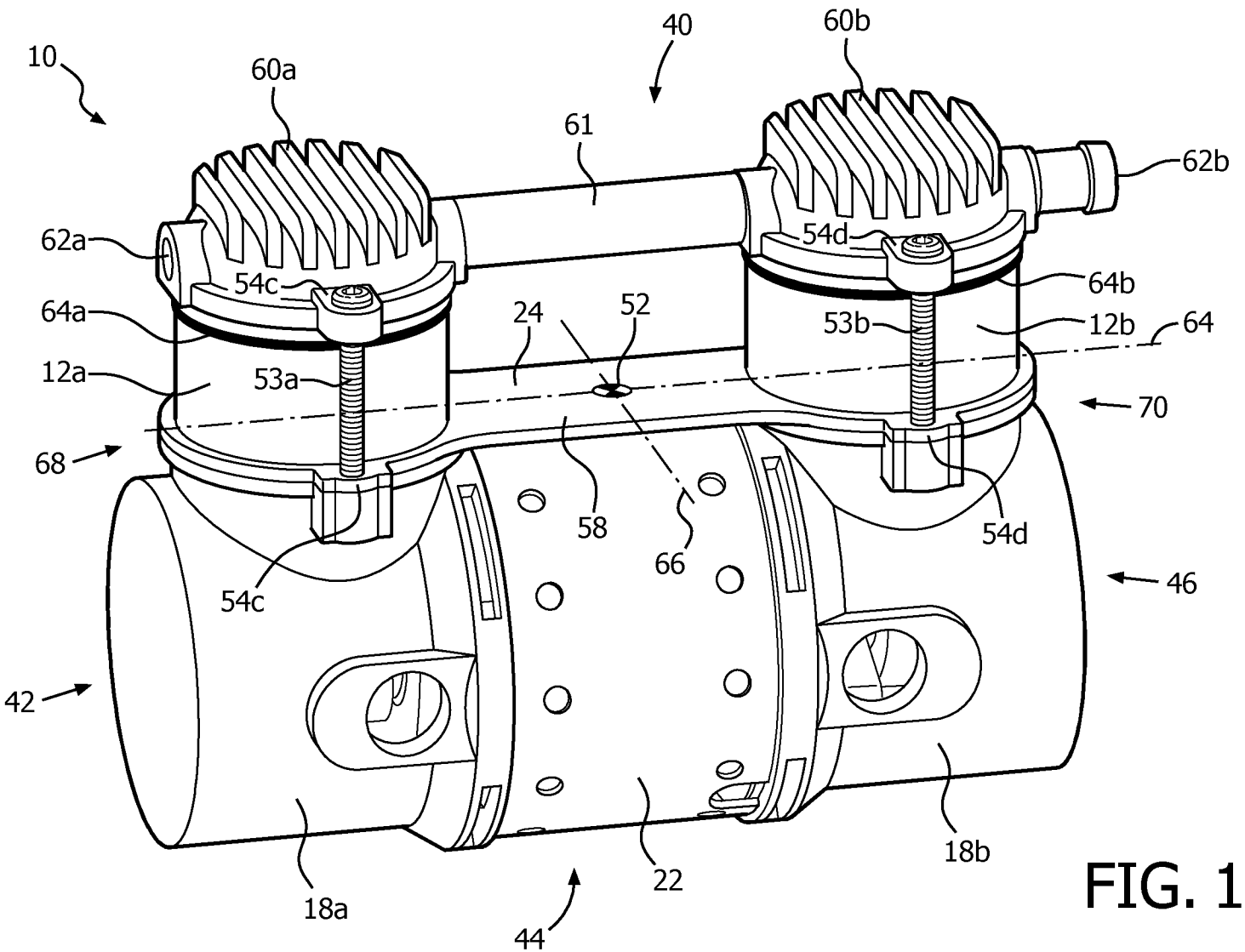
FIG. 1A illustrates an embodiment of a compressor assembly with a connector shown in a perspective.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 1B:
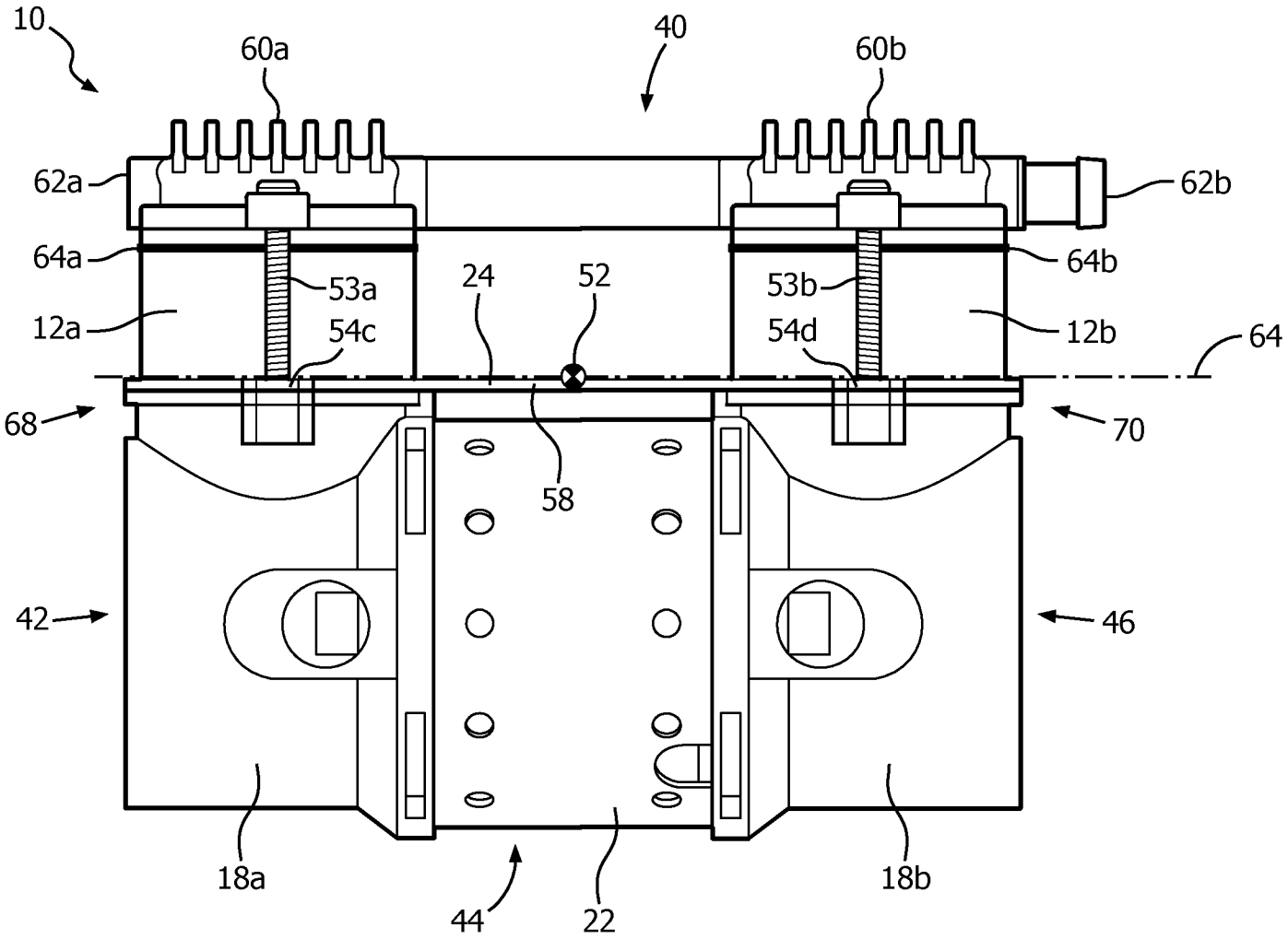
FIG. 1B illustrates a side view of the embodiment of the compressor assembly.
Figure 1C:
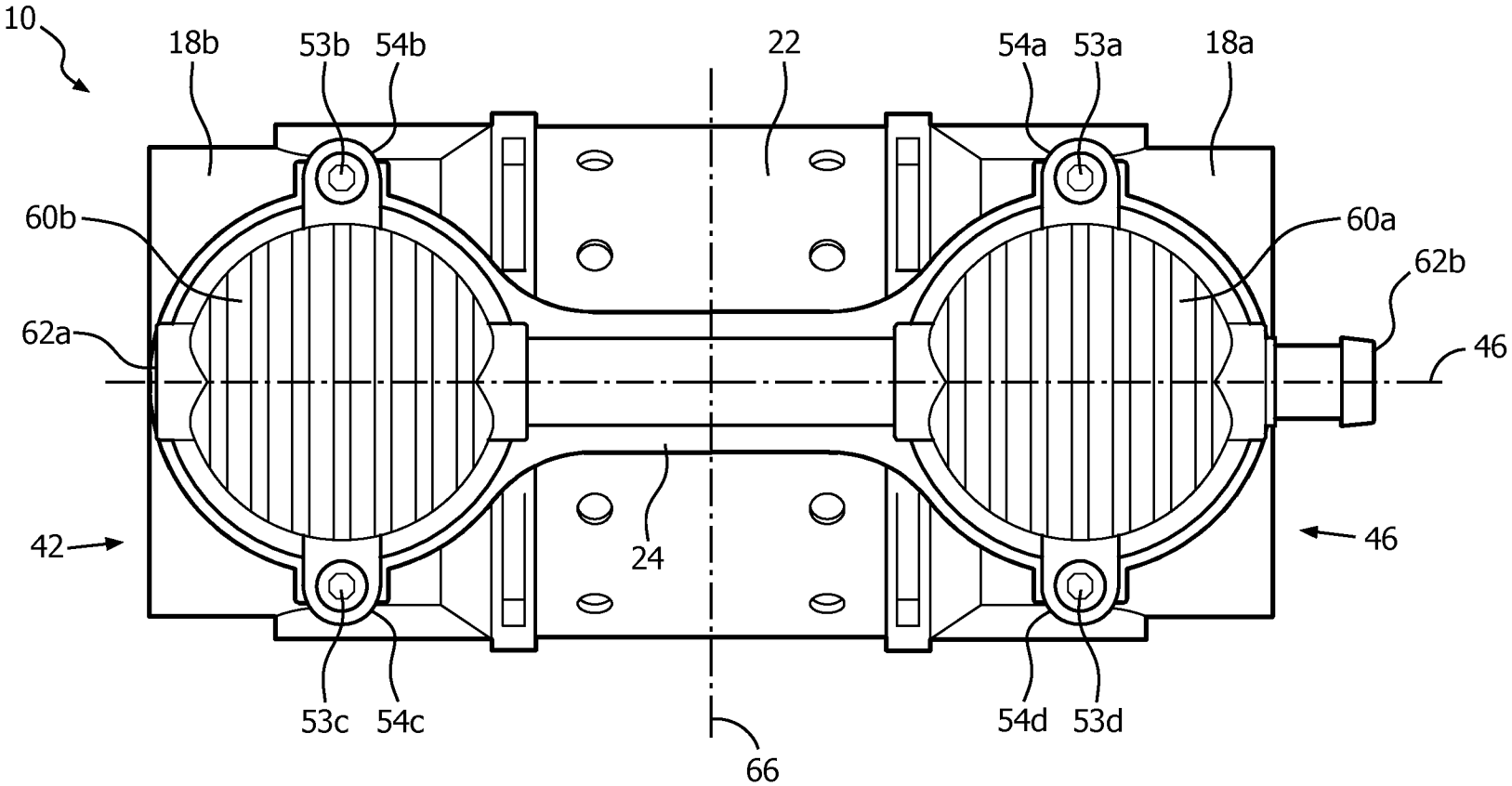
FIG. 1C illustrates a top view of the embodiment of the compressor assembly.

FIG. 1A-FIG. 1C schematically illustrate an exemplary embodiment of a compressor assembly 10 including a connector 24 for operatively coupling components of compressor assembly 10. FIG. 1A illustrates a perspective view of compressor assembly 10 and connector 24. FIG. 1B illustrates a side view of compressor assembly 10 and connector 24. FIG. 1C illustrates a top view of compressor assembly 10 and connector 24. Compression assembly 10 is configured to compress gas. Connector 24 is configured to couple one or more cylinders 12 of compressor assembly 10 with one or more crank shaft housings 18 of compressor assembly 10. Connector 24 provides structural rigidity to compressor assembly 10. In some embodiments, the location of connector 24 may be at or near a center of gravity of compressor assembly 10 to reduce vibrational eccentricities when compressor assembly 10 is operating. Connector 24 may be thermally conductive to conduct heat away from cylinders 12 and/or other components of compressor assembly 10.

Figure 2:
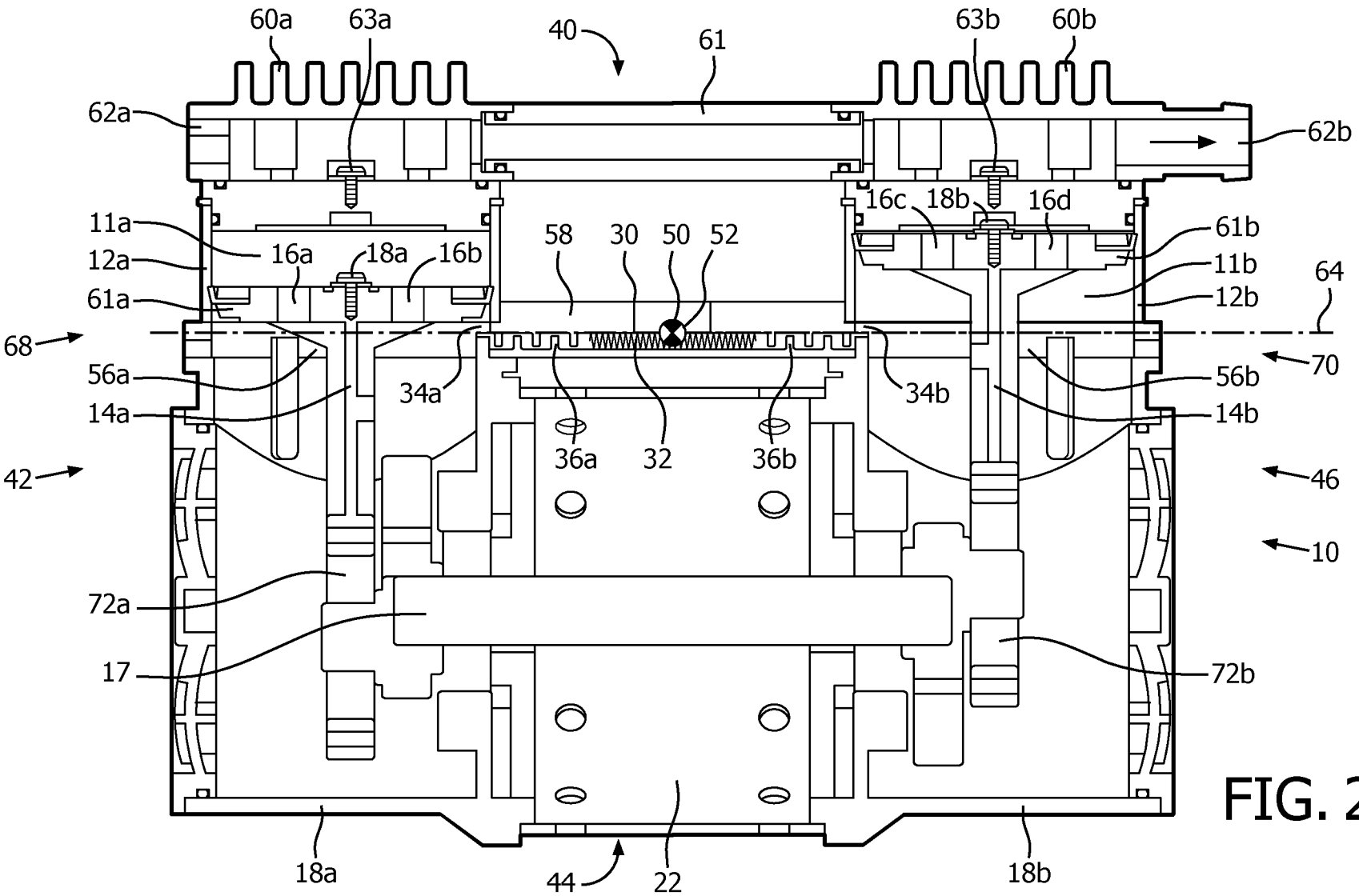
FIG. 2 is a cross-sectional view of one embodiment of a compressor assembly with a connector.

FIG. 2 illustrates a cross section of one embodiment of compressor assembly 10 and connector 24. FIG. 2 illustrates center of gravity 50. In some embodiments, compressor assembly 10 includes a first cap seal 60*a*, a first pressurized outlet 62*a*, a first cylinder 12*a*, a first space 11*a*, a first cup seal 61*a*, a first piston 14*a*, a first crank shaft housing 18*a*, a first crank shaft 72*a*, a motor housing 22, a motor (not shown), a motor shaft 17, a second crank shaft housing 18*b*, a second crank shaft 72*b*, a second cylinder 12*b*, a second piston 14*b*, second cup seal 61*b*, second space 11*b*, a second pressurized outlet 62*b*, a second cap seal 60*b*, and/or other components.

First cap seal 60*a* is illustrated on a first side 40 of compressor assembly 10. First cylinder 12*a* is located long a second side 42 toward a third side 44 of compressor assembly 10 from first cap seal 60*a*. First cap seal 60*a* and first cylinder 12*a* are operatively coupled which may enhance thermal conduction and/or convection. First cylinder 12*a* houses first piston 14*a* located within first cylinder 12*a* and along second side 42 of compressor assembly 10. First piston 14*a* reciprocates within first space 11*a* defined by first cylinder 12*a*, and first cap seal 60*a*. First cylinder 12*a* is operatively coupled with first crank shaft housing 18*a*, which is located along second side 42 at third side 44 of compressor assembly 10.

First crank shaft housing 18*a* encloses first crank shaft 72*a*, is operatively coupled to first piston 14*a*, and is configured to drive first piston 14*a*. In some embodiments first crank shaft 72*a* is operatively coupled with motor shaft 17 that provides torsional energy from the motor (not shown) housed within motor housing 22. As illustrated in FIG. 2, motor shaft 17 is operatively coupled with second crank shaft 72*b* housed within second crank shaft housing 18*b* located at third side 44 along fourth side 46 of compressor assembly 10.

Second crank shaft 72*b* is configured to drive second piston 14*b* to compress gas within second reciprocating space 11*b*. Second space 11*b* is defined by second piston 14*b*, second cylinder 12*b*, and second cap seal 60*b* on along fourth side 46 of compressor assembly 10. The components along fourth side 46 of compressor assembly 10 may be the same and/or similar to the components located along second side 42 of the compressor assembly 10. For example, first cap seal 60*a* located along second side 42 may be the same and/or similar to second cap seal 60*b* located along fourth side 46. As shown in FIG. 2, in some embodiments compressor assembly 10 may include one or more valve screws 18*a*, 18*b*, one-way valves 16*a*, 16*b*, 16*c*, 16*d*, pressure tube 61, cap seal screws 63*a*, 63*b*, and/or other components.

Compressor assembly 10 has a tandem arrangement with two cylinders 12*a* and 12*b*, each having a piston 14*a* and 14*b* received therein and configured to alternate compressing fluid in cylinder 12*a* and 12*b* with the other opposed piston 14*a* and 14*b*. Cylinders 12*a* and 12*b* form spaces 11*a* and 11*b* for compressing the fluid. Pistons 14*a* and 14*b* are configured to reciprocate within the spaces 11*a* and 11*b* so as to compress the fluid against cup seals 61. However, this embodiment is not intended to be limiting. It is contemplated that compressor assembly 10 may have other arrangements. For example, compressor assembly 10 may have a single and/or dual acting design. Compressor assembly 10 may also include more than two cylinders 12.

As shown in FIG. 2, pistons 14*a* and 14*b* are configured to alternately reciprocate within cylinders 12*a* and 12*b* respectively so as to compress the fluid. Crank shafts 72*a* and 72*b* are configured to drive pistons 14*a*, 14*b* within cylinders 12*a* and 12*b*. In this embodiment, the pistons 14*a*, 14*b* are wobble (WOB-L) pistons. However, it is contemplated that other types of pistons may be used in other embodiments of assembly 10. Crank shafts 72*a* and 72*b* are housed in crank shaft housings 18*a* and 18*b* that are operatively coupled with cylinders 12*a* and 12*b*. Two crank shaft housings 18*a*, 18*b* are provided, each being associated with one cylinder 12*a*, 12*b*. A motor (not shown) is operatively connected to crank shafts 72*a* and 72*b* and is configured to drive crank shafts 72*a* and 72*b*. The motor (not shown) is housed in a motor housing 22 that is operatively coupled to crank shaft housings 18*a*, 18*b*.

FIG. 2 illustrates pistons 14 having a lower end with a bearing center configured to receive a portion of the crank shafts 72*a* and 72*b*. Crank shafts 72 in FIG. 2 are offset and not in linear correlation to the axis of motor shaft 17. In this configuration, motor shaft 17 and pistons 14*a*, 14*b* are configured to be eccentric. The eccentric crank shafts 72*a* and 72*b* are connected to motor shaft 17 such that the axis defined by motor shaft 17 is offset from the axis defined by the center of the bearings.

In some embodiments, motor housing 22 includes a motor (not shown) configured to drive crank shafts 72. Motor shaft 17 rotates crank shaft 72, which in turn causes pistons 14*a*, 14*b*, to reciprocate upwardly and downwardly within cylinders 12*a*, 12*b*. This configuration enables pistons 14*a*, 14*b* to tilt relative to cylinders 12*a*, 12*b* at all positions (except when pistons 14*a*, 14*b* are positioned such that they are located nearest the first side 40 and third side 44 of FIG. 1) due to the eccentricity of crank shaft 72. It is contemplated that crank shaft 72 does not need to be eccentric and may have other configurations or arrangements. As an example, piston 14*a* shown in FIG. 2 is in the bottom most position and piston 14*b* shown in FIG. 2 is in the top most position. This configuration of pistons 14*a* and 14*b* and crank shafts 72 converts the rotary energy from the motor (not shown) into linear motion of pistons 14*a*, 14*b* within cylinders 12*a*, 12*b*. This configuration enables compressor assembly 10 to increase the pressure of the fluid.

Movement of pistons 14*a* and 14*b* within cylinders 12*a* and 12*b* causes heat to increase in compressor assembly 10. The heat is conducted and/or convected via cap seals 60*a*, 60*b* from the cylinders 12*a*, 12*b* due to the frictional engagement between the cup seals 61*a*, 61*b* and the inner surface of spaces 11*a* and 11*b* of the cylinders 12*a*, 12*b*, and/or due to the compression of fluid. The cylinders 12*a* and 12*b* may be used as a heat sink to conduct the heat to the cap seals 60*a* and 60*b*. An external cooling fan (not shown) may be provided to generate cooling current for convection of heat away from compressor assembly 10.

In some embodiments, one or more components of compressor assembly 10 described herein may be similar to and/or the same as one or more components of the compressor assembly described in U.S. Patent Application No. 61/377,607, entitled "Method And Apparatus For Isolating Electric Motor Thermal Energy", filed Aug. 27, 2010, which is hereby incorporated by reference in its entirety.

Returning to FIG. 1A-FIG. 1C, connector 24 is positioned between first cylinder 12*a* and second cylinder 12*b* to provide structural support to compressor assembly 10 and couple cylinders 12*a*, 12*b* to crank shaft housings 18*a*, 18*b*. Connector 24 is disposed between first cylinder 14*a* and second cylinder 14*b*, and outside of first crank shaft housing 18*a*, second crank shaft housing 18*b*, and motor housing 22. As shown in FIG. 1A, in some embodiments compressor assembly 10 may include one or more of pressure tube 61, seals 64*a*, 64*b*, transverse screws 53*a*, 53*b*, and/or other components.

Connector 24 may be configured to maintain operative couplings between crank shaft housings 18 (FIG. 1A) and motor housing 22 (FIG. 1A) by providing axial rigidity against the expansion of these components in an axial direction (e.g., axial direction 64 described in FIG. 3 below). In some embodiments, connector 24 may eliminate the need for a fastener and/or bolt used to connect first crank shaft housing 18*a* (FIG. 1A) with second crank shaft housing 18*b* (FIG. 1B) enclosing motor housing 22 (FIG. 1A). The size, placement, configuration, and/or other properties of connector 24 may be configured to provide structural rigidity, thermal isolation, thermal conduction, reduced vibrational eccentricities, and/or other advantages for compressor assembly 10. In some embodiments connector 24 may be monolithic, comprised of a single material to enhance structural rigidity and/or thermal conduction. Connector 24 is disposed between the two or more cylinders 12 and/or crank shaft housings 18. Connector 24 may engage the cylinders 12 such that vibration during operation of the compressor assembly is reduced through the placement of connector 24. For example, the location of connector 24 may correspond to a center of gravity of the compressor assembly 10 (e.g., center of gravity 50 shown in FIG. 2). The placement of connector 24 at or near the center of gravity may reduce vibrational eccentricities. This and/or other features of connector 24 may make it easier to mount compressor assembly 10 to other equipment. This may also reduce a need for damping for compressor assembly 10 and reduce cost.

Figure 3:
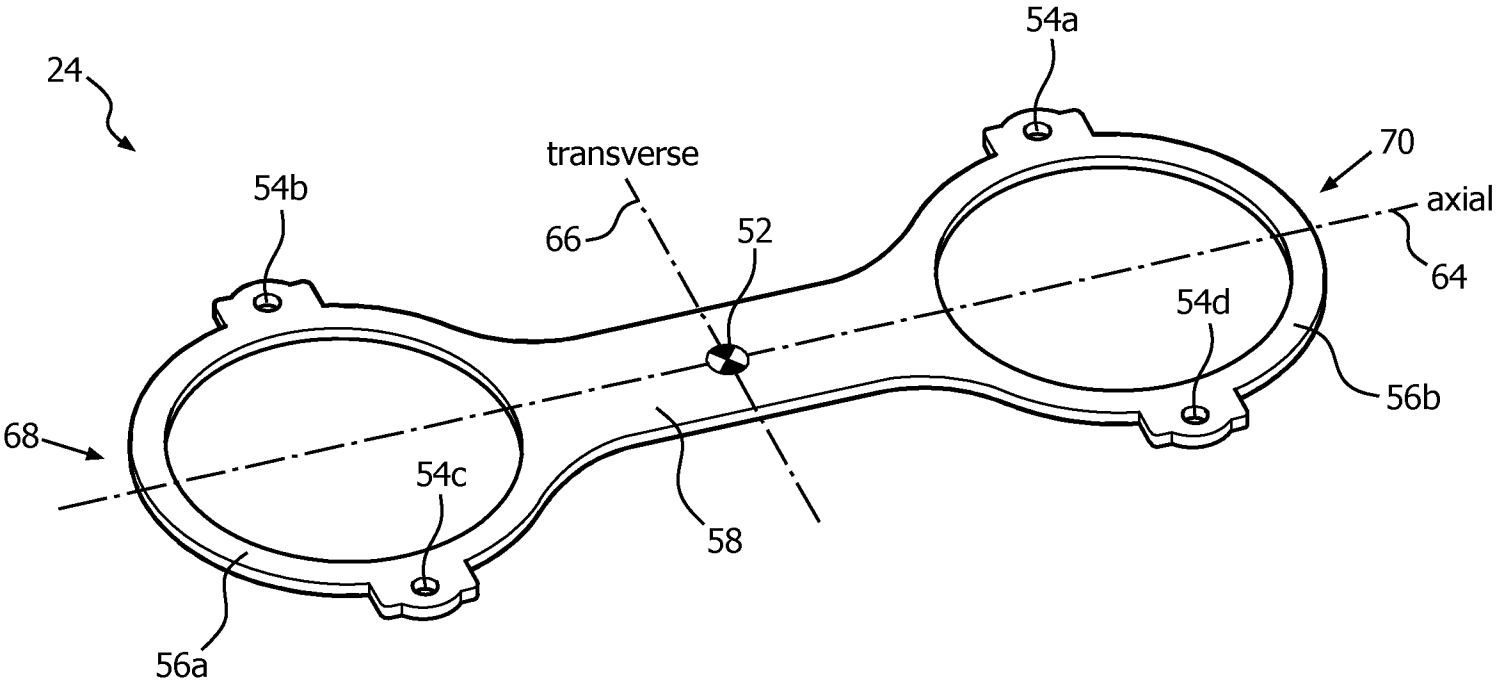
FIG. 3 illustrates a connector component.

FIG. 3 illustrates an embodiment of connector 24. Connector 24 includes a first annular ring 56*a* located near a first side 68 of connector 24, fastener connections 54*a*, 54*b*, 54*c*, 54*d*, a neck 58, center of gravity 52, a second annular ring 56*b* located near a second side 70 of connector 24, and/or other components. Neck 58 is located between first annular ring 56*a* and second annular ring 56*b* and is oriented in an axial direction 64. Connector 24 engages the first cylinder 14*a* (FIG. 1A-FIG. 1C) with a first annular ring 56*a* and the second cylinder 14*b* (FIG. 1A-FIG. 1C) with a second annular ring 56*b* of connector 24. Connector 24 may have fastener connections 54*a*, 54*b*, 54*c*, 54*d* as illustrated in FIG. 3. Fastener connections 54 may be located along first annular ring 56*a* and/or second annular ring 56*b* and oriented in a transverse direction 66 relative to neck 58. Fastener connections 54 may enable the cap seal 60 (shown in FIG. 1A) to maintain a structural connection with crank shaft housing 18 (illustrated in FIG. 1). Neck 58 may transmit structural load, thermal energy, and/or provide other functionality. During operation, connector 24 maintains operative couplings with annular rings 56 between first cylinder 14*a* coupled with first crank shaft housing 18*a* and second cylinder 14*b* coupled with second crank shaft housing 18*b*. Neck 58 (along axial direction 64) provides structural rigidity for connector 24 to ensure that motor housing 22 remains operatively coupled with first crank shaft housing 18*a* and second crank shaft housing 18*b* during operation.

In some embodiments, connector 24 may be manufactured and/or assembled with compressor assembly 10. In some embodiments, connector 24 may be retrofit into existing compressor assemblies 10. That is, the compressor assemblies 10 may already be manufactured and assembled without connector 24. In such embodiments, connector 24 may be coupled with compressor assembly 10 at a later time. In some embodiments, a center of gravity 52 of connector 24 may be located near center of gravity 50 of the compressor assembly 10 (FIG. 2).

Connector 24 may be formed from steel, stainless steel, aluminum, and or any other material or combination of materials. The materials may have wear resistant properties, low creep, may be constructed at a low cost, and/or have other properties. Other materials may include glass filed nylon (e.g., 30% glass filled Nylon 66), Teflon, ceramics having properties of low creep, plastics having low creep, and/or other materials with high thermal conductivity and low creep, for example.

In some embodiments, the placement of connector 24 may improve the structural rigidity of the compressor assembly. For example, because the compressor assembly 10 has eccentricities during operation the forces required to mount and dampen the vibrations of compressor assembly 10 in operation may be reduced by placing connector 24 near center of gravity 50 (FIG. 2) of connector assembly 10.

Returning to FIG. 1, thermal disparities between cylinders 12, cup seals 61, crank shaft housings 18, and/or motor housing 22 may cause a cup seal in one cylinder 12 (e.g. cylinder 12*a*) of compressor assembly 10 to fail prematurely (e.g. before the failure of the cup seal in cylinder 12*b*). For example, if first cylinder 12*a* has more friction between cup seal 61*a* and cylinder 12*a* than between second cup seal 61*b* and second cylinder 12*b* in the compressor assembly, more heat may be generated at the first cylinder and cause thermal stresses that fail the cup seal in first cylinder 12 prematurely. In some configurations, compressor assembly 10 may be arranged so that one cylinder 12 is further from a fan (not shown) than the other cylinder 12. During the operation of compressor assembly 10 thermal disparities may arise between the components of compressor assembly 10 and specifically the cup seals 61/cylinders 12.

Heat stresses may accumulate if the thermal energy cannot be dissipated. Thus, the configuration of compressor assembly 10 should be designed to dissipate heat such that the cylinders 12, pistons 14, cup seals 61, crank shaft housings 18, and/or motor housing 22 remain at or near a uniform temperature. Connector 24 is thermally conducive to enable heat conduction away from the compressor assembly 10 to the environment and to remove and/or reduce thermal disparities among the component parts of compressor assembly 10. The size and thickness of the connector 24 may be varied based on the configuration and arrangement of the cylinders 12, crank shaft housings 18, and/or motor housing 22. For example, as mentioned above and as shown in FIG. 2, each generally cylindrical crank shaft housing 18 is coupled with an annular section of cylinder 12. Connector 24 may be configured to be disposed on cylinder 12 and/or the crank shaft housing 18 such that connector 24 (an annular ring 56*a* or 56*b* shown in FIG. 3) forms a periphery around cylinders 12 and/or crank shaft housings 18 and conducts heat away from cylinders 12 and/or crank shaft housings 18.

Figure 4A:
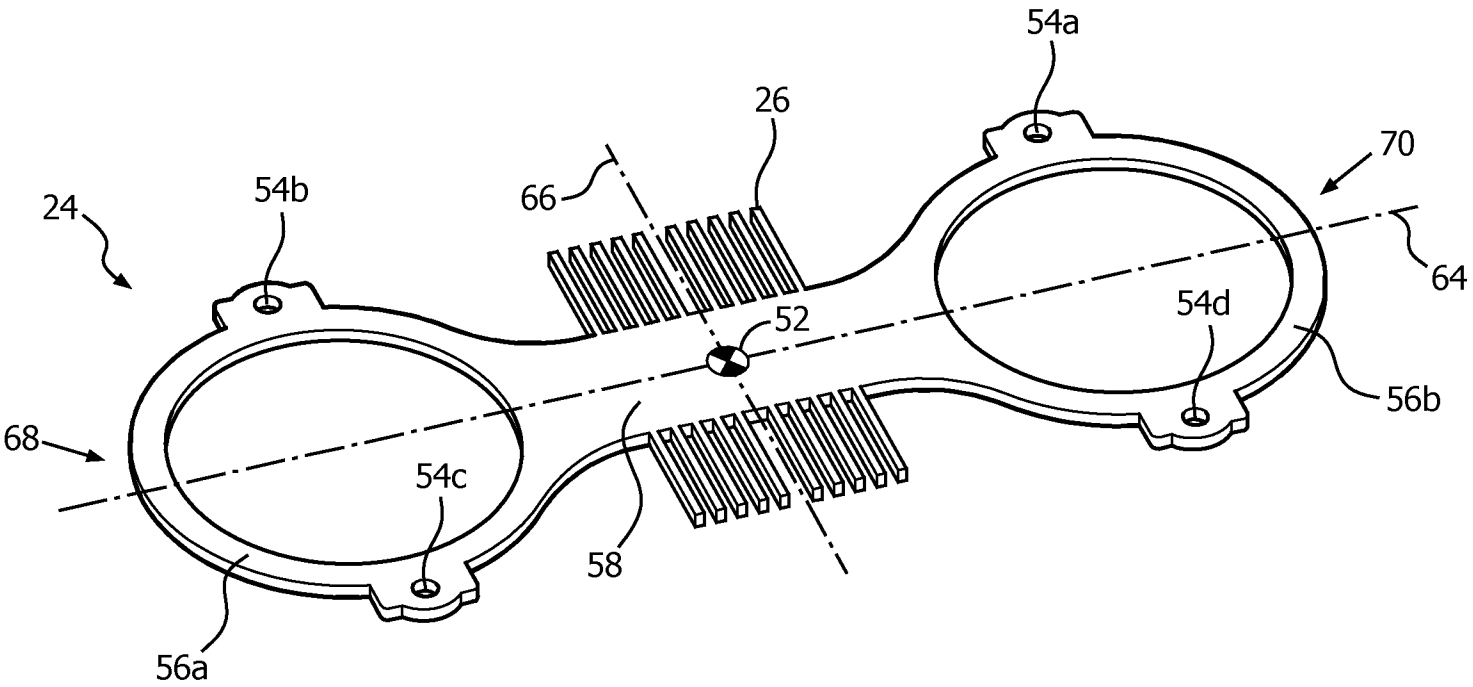
FIG. 4A illustrates an embodiment of a connector with heat fins extending in the transverse direction.
Figure 4B:
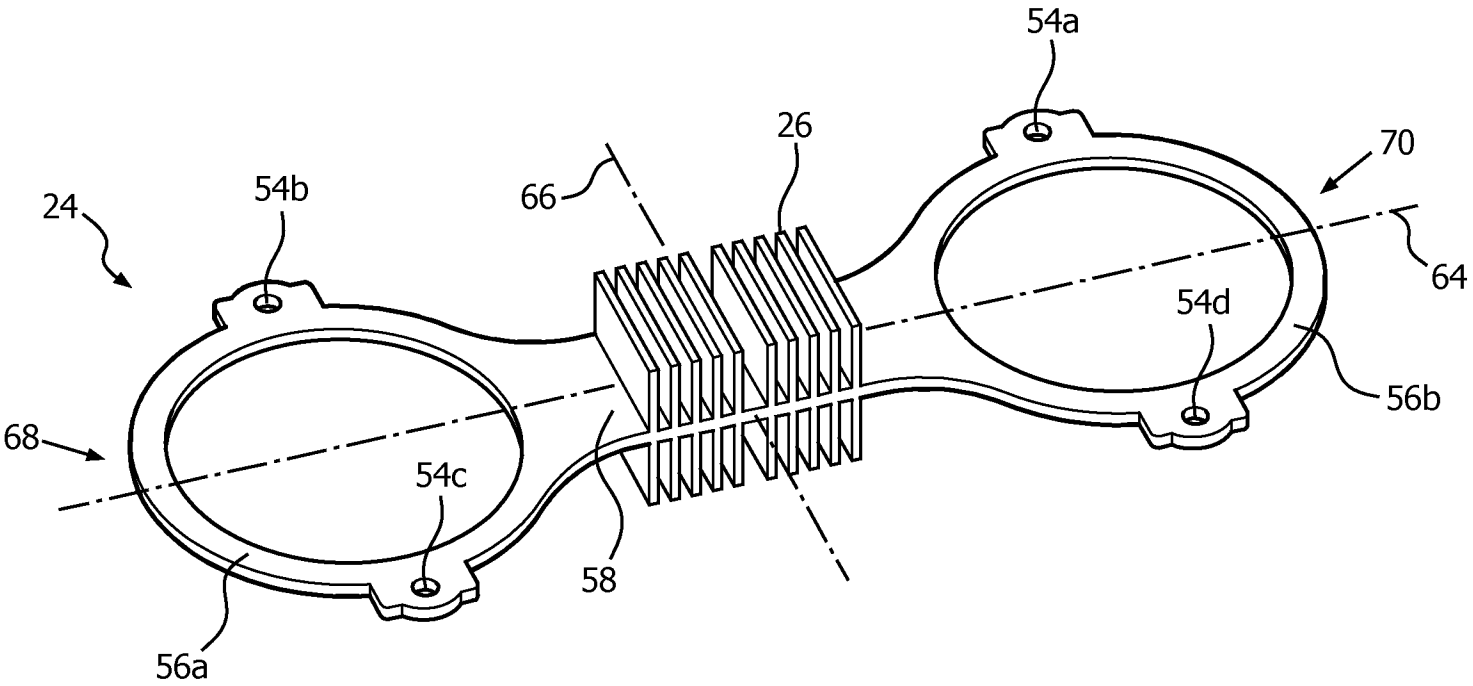
FIG. 4B illustrates another embodiment of a connector with thick heat fins.

FIGS. 4A and 4B illustrate embodiments of connector 24 configured to enhance the thermally dissipative properties of connector 24. Connector 24 may be thermally conductive to conduct heat away from the cylinders 12*a*, 12*b* (FIG. 1A) and/or other components of compressor assembly 10, and provide a surface area for convective cooling such that temperatures of the cylinders 12*a* and 12*b* (FIG. 1A) and/or other components of compressor assembly 10 remain substantially the same. Connector 24 may enlarge a surface area for convective cooling of the cylinders 12*a* and 12*b* (FIG. 1A). For example, connector 24 may have one or more heat fins 26 to facilitate thermal cooling of the compressor assembly 10. In FIGS. 4A and 4B, heat fins 26 are generally rectangular in cross section and are located near center of gravity 52. However, these FIGS. are not intended to be limiting. Connector 24 may have any shape (including any number, shape, direction, and/or size of heat fins) provided connector 24 functions as described herein and is not limited to the examples shown in the figures.

One or more components of connector assembly 10 (FIG. 1A-1C) may be made of aluminum and/or coated with an anodized coating. Anodized coatings may improve structural and corrosive properties of these components, but, the anodized coating may interfere with the thermal conductivity of these components. For example, cylinders 12 (FIG. 1A-1C) may have an anodized coating to improve the properties thereof, such as to increase their corrosion resistance and/or wear resistance. However, the anodized coating in such embodiments may cause the thermal conductivity of cylinders 12 to decrease. As such, the effectiveness of the heat dissipation from cylinders 12 to the crank shaft housings 18 is also decreased and connector 24 is especially advantageous.

In some embodiments, connector 24 is anodized. The lowered thermal conductivity of connector 24 (e.g., due to the annodization) may be problematic because the coupling between cylinders 12 and crank shaft housings 18 functions to remove heat from cylinders 12 and conduct the heat to a heat sink (e.g., fins 26) in connector 24 (e.g., as described above). Lowered thermal conductivity due to anodized coatings on the connector 24 may impede the heat flow from cylinder 12 (FIG. 1A-1C) and/or crank shaft housings 18 (FIG. 1A-1C) of heat generated in the cylinders 12*a*, 12*b* by the frictional engagement between the pistons 14 (FIG. 2) and/or cup seals 61 (FIG. 2) and the inner surfaces of cylinders 12, the motor, and/or by the compression of fluid. To combat this, an anodized coating of connector 24 may be ground on the inner diameter of the annular ring(s) 56*a*, 56*b* (FIG. 3) to decrease the anodized coating thereon, such that the thermal conductivity may be increased. Similarly, cylinders 12, crank shaft housings 18, and/or other components may be ground at the coupling with connector 24 to enhance thermal conduction. By grounding the anodized parts, the thickness of the anodized coating is decreased such that the anodized coating is thin enough to ensure adequate dissipation of heat. In some embodiments, connector 24 may be beveled due to grounding thereof. Any tools and/or methods may be used to ground the anodized coatings.

It is also contemplated that any abrasive material may be used to ground the anodized coatings. In some embodiments, connector 24 may have an anodized coating having a thickness of less than about 0.001 inches. In some embodiments, connector 24 may have an anodized coating having a thickness of about 0.0005 inches to about 0.005 inches. In some embodiments, connector 24 may have an anodized coating having a thickness of about 0.001 inches. In some embodiments, the anodized coating may be completely removed. In one embodiment, rather than grinding down an existing anodized coating, a coating of a lesser thickness (or no coating at all) may be formed connector 24 separate from the coating formed on cylinder 12 and/or crank shaft housing 18.

Figure 5A:
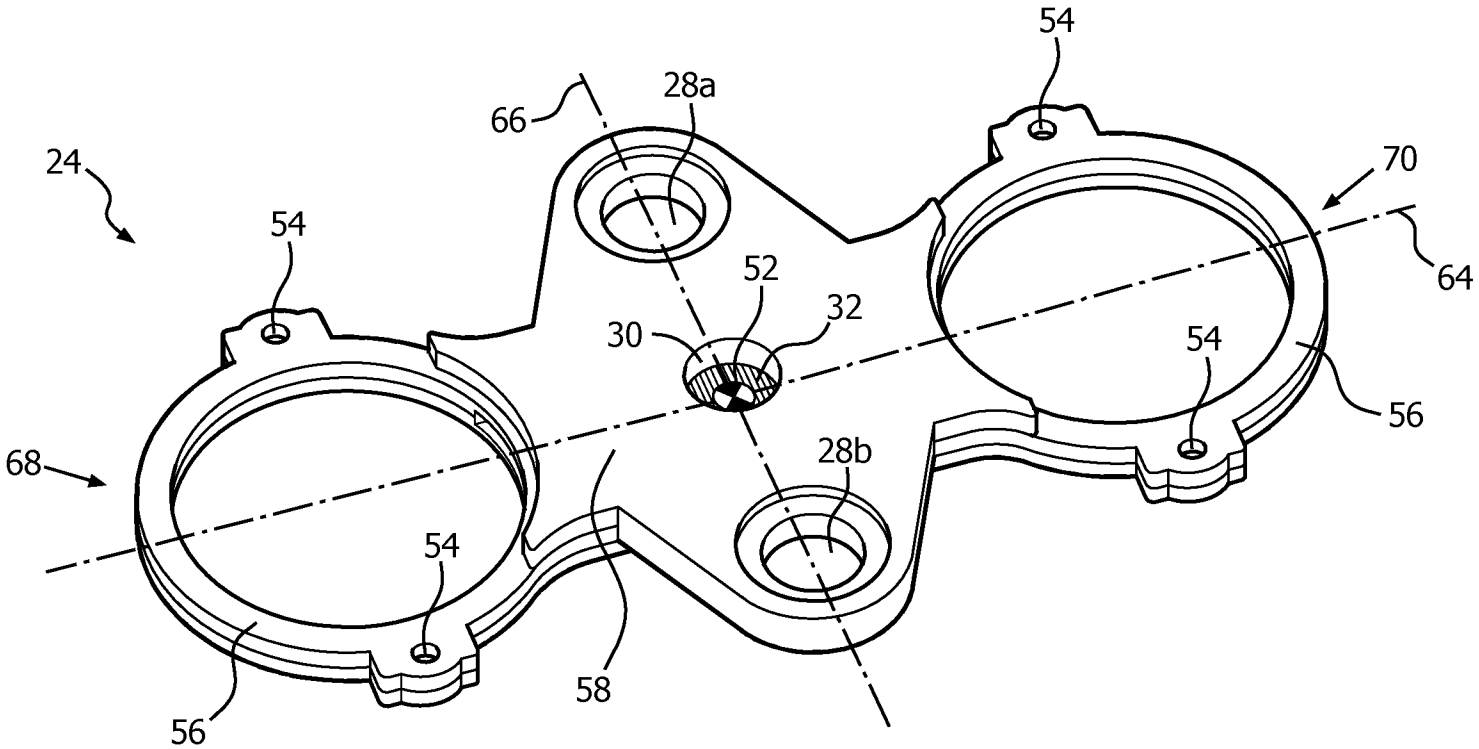
FIG. 5A illustrates an embodiment of the connector with mounts and an inlet to a compressor assembly.
Figure 5B:
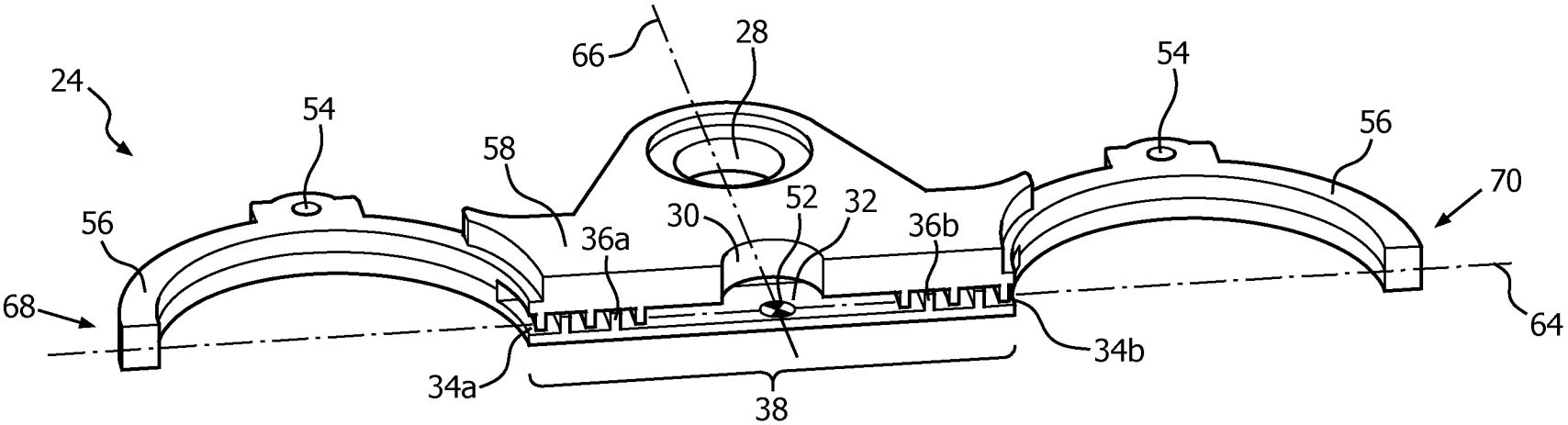
FIG. 5B illustrates a cross sectional view of the connector, showing a flow path from an inlet, through a filter, a noise muffler, and an outlet.

Connector 24 may be configured to reduce the number of parts needed to assemble a typical compressor assembly. FIGS. 5A and 5B illustrate connector 24 configured with a fluid inlet 30, outlets 34, filter compartments 32, noise muffling features 36, and/or other components. FIG. 5A illustrates one embodiment of connector 24 with mounts 28*a*, 28*b* and fluid inlet 30 to compressor assembly 10. FIG. 5B illustrates a cross-sectional view of connector 24, including a flow path 38 from inlet 30, through filter compartments 32, noise mufflers 36*a*, 36*b*, and outlets 34*a*, 34*b*. In some embodiments, outlets 34*a* and 34*b* may supply gas to be compressed within spaces 11*a* and 11*b* (FIG. 2) of compressor assembly 10 respectively.

As shown in FIG. 5A, connector 24 includes mounts 28*a* and 28*b* for fixing compressor assembly 10 (not shown) and/or connector 24 to a support (not shown). As shown in FIG. 5B, in some embodiments, connector 24 is configured to transport fluid communicated and pressurized by compressor assembly 10. In this embodiment, connector 24 comprises one or more features including fluid inlet 30, outlet 34*a*, 34*b*, flow path 38, filter compartment 32, noise muffler 36, mounts 28, and/or other components.

Inlet 30 is configured to receive the fluid from a fluid source and communicate the fluid to flow path 38. Flow path 38 is configured to conduct the fluid from fluid inlet 30 to outlets 34*a*, 34*b* and may include filter compartments 32 and/or noise muffling features 36. Outlets 34 are coupled to cylinders 12 and are configured to communicate fluid to spaces 11 within cylinders 12 to compress the fluid with pistons 14 (FIG. 2).

In some embodiments, filter compartment 32 is included within flow path 38. Filter compartment 32 may receive a separate filter and/or may form a filtering apparatus by itself (e.g., via features of flow path 38). Filter compartment 32 may facilitate filtering impurities in the fluid such as water, carbon monoxide, germs, bacteria, and/or other impurities from the flow of fluid. Noise muffling features 36 may be included within flow path 38 to muffle the noises generated by compressor assembly 10, the flow of fluid, and/or other noises generated during operation of compressor assembly 10. Noise muffling features 36 may include various geometric formations of flow path 38 and absorb and/or otherwise reduce noise created when fluid flows through flow path 38.

Figure 6:
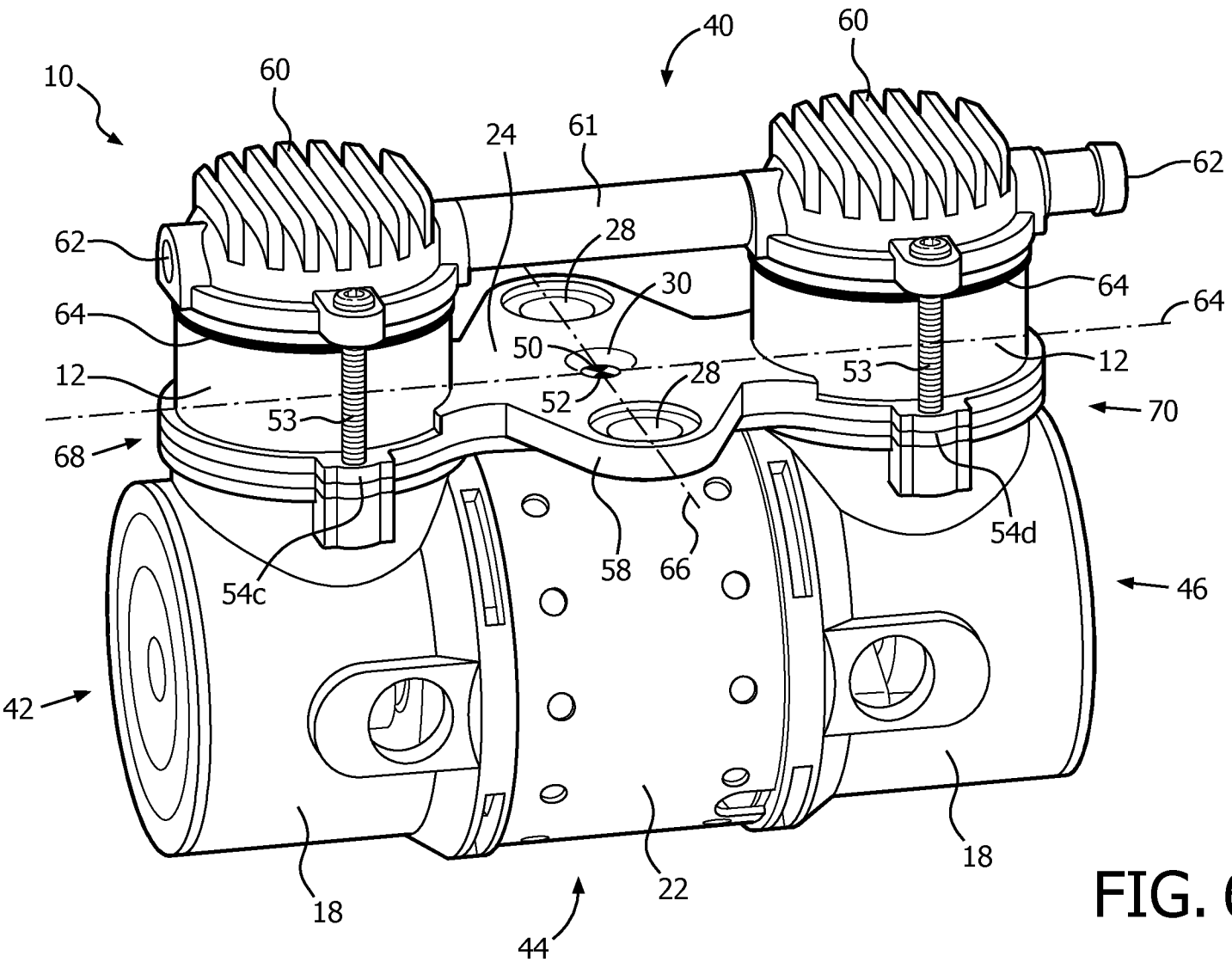
FIG. 6 is a perspective view of one embodiment of the connector including mounts, an inlet, a filter, a noise muffler, and an outlet.

FIG. 6 illustrates an embodiment of connector 24 that includes mounts 28*a* and 28*b* coupled with compressor assembly 10. In this embodiment, connector 24 and mounts 28*a* and 28*b* are located near the center of gravity (FIG. 2) of compressor assembly 10. Inlet 30 is provided to allow the fluid to pass through filter compartment 32 (FIG. 5B, noise muffler 36 (FIG. 5B), outlet 34 (FIG. 5B), for example. Mounts 28*a* and 28*b* facilitate mounting compressor assembly 10 to one or more other components via connector 24.

Figure 7:
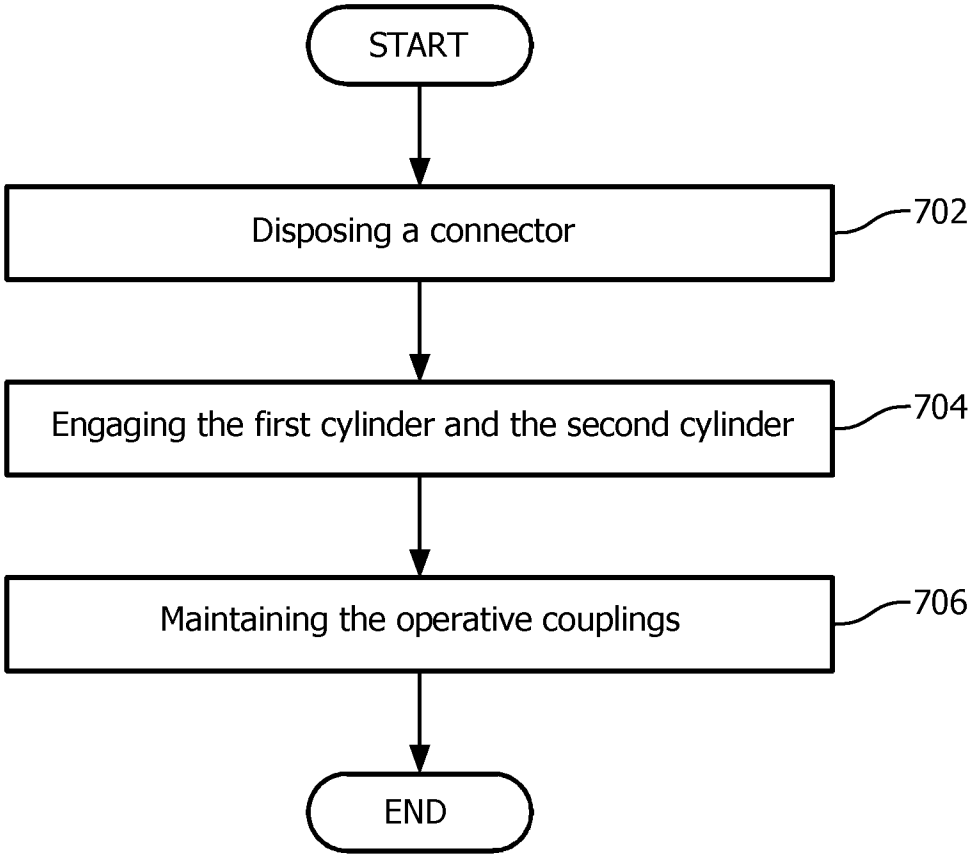
FIG. 7 illustrates a method of connecting a compressor assembly.

FIG. 7 illustrates a method 700 for connecting a compressor assembly and maintaining operative couplings in the compressor assembly. The compressor assembly includes a first cylinder that forms a first space for compressing a fluid, a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder; a second crank shaft housed within the second crank shaft housing, the second crank shaft being configured to drive the second piston; a motor housing operatively coupled with the first crank shaft housing and the second crank shaft housing; a motor housed within the motor housing, the motor being configured to drive the first crank shaft and the second crank shaft; and/or other components.

The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting.

At an operation 702, a connector is disposed between the first cylinder and the second cylinder outside the first crank shaft housing, the second crank shaft housing, and the motor housing. In some embodiments, the connector is disposed such that the position of the connector corresponds to a center of gravity of the compressor assembly. In some embodiments, operation 702 is performed by a connector the same as or similar to connector 24 (shown in FIG. 1A and described herein).

At an operation 704, the first cylinder and the second cylinder are engaged with the connector. In some embodiments, the connector is thermally conductive and provides a thermally conductive path between the cylinders such that temperatures of the cylinders remain substantially the same. In some embodiments, the connector is thermally conductive, conducts heat away from the cylinders, and provides a surface area for convective cooling such that temperatures of the cylinders remain substantially the same. In some embodiments, operation 704 is performed by a connector the same as or similar to connector 24 (shown in FIG. 1A and described herein).

At an operation 706 the operative couplings between the first cylinder and the first crank shaft housing, the second cylinder and the second crank shaft housing, and the motor housing with the first crank shaft housing and the second crank shaft housing are maintained. In some embodiments, the connector comprises one or more of an inlet, an outlet, a flow path, a filter compartment, or noise muffling features, wherein the inlet is configured to receive the fluid from a fluid source; the outlet is coupled to the first space formed by the cylinders and configured to communicate fluid to the first space formed by the cylinders; the flow path is configured to conduct the fluid from the inlet to the outlet; the filter compartment is formed by the flow path and configured to receive a filter that filters the fluid being conducted from the inlet to the outlet; and the noise muffling features are formed by the flow path and muffle noises generated by fluid in the flow path and/or the compressor assembly. In some embodiments, operation 706 is performed by a connector is the same as or similar to connector 24 (shown in FIG. 1A and described herein).

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A compressor assembly configured to increase pressure of a fluid, the compressor assembly comprising:

a first cylinder that forms a first space for compressing a fluid;

a first piston housed within the first cylinder, the first piston being configured to reciprocate within the first cylinder so as to compress the fluid within the first space;

a second cylinder that forms a second space for compressing the fluid that is separate from the first space;

a second piston housed within the second cylinder, the second piston being configured to reciprocate within the second cylinder so as to compress the fluid within the second space;

a first crank shaft housing operatively coupled with the first cylinder;

a first crank shaft housed within the first crank shaft housing, the first crank shaft being configured to drive the first piston;

a second crank shaft housing operatively coupled with the second cylinder;

a second crank shaft housed within the second crank shaft housing, the second crank shaft being configured to drive the second piston;

a motor housing operatively coupled with the first crank shaft housing and the second crank shaft housing;

a motor housed within the motor housing, the motor being configured to drive the first crank shaft and the second crank shaft;

a pressure conduit disposed between the first cylinder and the second cylinder; and outside of the first crank shaft housing, the second crank shaft housing, and the motor housing, the pressure conduit configured to provide a pathway for conducting the fluid between the first cylinder and the second cylinder; and a connector disposed between the first cylinder and the second cylinder, and outside of the first crank shaft housing, the second crank shaft housing, and the motor housing, the connector engaging the first cylinder and the second cylinder, with the connector maintaining the operative couplings between the first cylinder and the first crank shaft housing, the second cylinder and the second crank shaft housing, and the motor housing operatively coupled with the first crank shaft housing and the second crank shaft housing, wherein the connector is monolithic, and a position of the connector corresponds to a center of gravity of the compressor assembly;

wherein the connector comprises one or more heat fins configured to facilitate thermal cooling of the compressor assembly; and wherein the connector is separated from the pressure conduit by the first cylinder and the second cylinder.

2. The compressor assembly of claim 1, wherein the connector is thermally conductive and provides a thermally conductive path between the first and second cylinders such that temperatures of the cylinders remain substantially the same.

3. The compressor assembly of claim 1, wherein the connector is thermally conductive, conducts heat away from the cylinders, and provides a surface area for convective cooling such that temperatures of the cylinders remain substantially the same.

4. The compressor assembly of claim 1, wherein the connector comprises an inlet, an outlet, a flow path, a filter compartment, and noise muffling features, wherein:

the inlet is configured to receive the fluid from a fluid source;

the outlet is coupled to the first space formed by the cylinders and configured to communicate fluid to the first space formed by the cylinders;

the flow path is configured to conduct the fluid from the inlet to the outlet;

the filter compartment is formed by the flow path and configured to receive a filter that filters the fluid being conducted from the inlet to the outlet; and the noise muffling features are formed by the flow path and muffle noises generated by fluid in the flow path and/or the compressor assembly.

5. The system of claim 1, wherein the one or more heat fins comprise a plurality of heat fins, with individual heat fins of the plurality of heat fins comprising parallel planar surfaces, and having rectangular cross sections.

6. A method to increase pressure of a fluid with a compressor assembly, the compressor assembly comprising a first cylinder that forms a first space for compressing a fluid, a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder a second crank shaft housed within the second crank shaft housing, the second crank shaft being configured to drive the second piston; a motor housing operatively coupled with the first crank shaft housing and the second crank shaft housing; a motor housed within the motor housing, the motor being configured to drive the first crank shaft and the second crank shaft; the method comprising:

disposing a pressure conduit between the first cylinder and the second cylinder, and outside of the first crank shaft housing, the second crank shaft housing, and the motor housing, the pressure conduit configured to provide a pathway for conduction the fluid between the first cylinder and the second cylinder;

disposing a connector between the first cylinder and the second cylinder outside the first crank shaft housing, the second crank shaft housing, and the motor housing, wherein the connector is monolithic and positioned in a location corresponding to a center of gravity of the compressor assembly, wherein the connector comprises one or more heat fins configured to facilitate thermal cooling of the compressor assembly, and wherein the connector is separated from the pressure conduit by the first cylinder and the second cylinder;

engaging the first cylinder and the second cylinder with the connector; and maintaining the operative couplings between the first cylinder and the first crank shaft housing, the second cylinder and the second crank shaft housing, and the motor housing with the first crank shaft housing and the second crank shaft housing.

7. The method of claim 6, further comprising providing a thermally conductive path between the first and second cylinders such that temperatures of the cylinders remain substantially the same.

8. The method of claim 6, further comprising conducting heat away from the cylinders, and providing a surface area for convective cooling such that temperatures of the cylinders remain substantially the same.

9. The method of claim 6, wherein the connector comprises an inlet, an outlet, a flow path, a filter compartment, and noise muffling features, for the method further comprising:

receiving the fluid from a fluid source at the inlet;

communicating fluid to the space formed by the cylinders through the outlet;

conducting the fluid from the inlet to the outlet with the flow path;

filtering the fluid being conducted from the inlet to the outlet; and muffling noises generated by fluid in the flow path and/or the compressor assembly.

10. The method of claim 6, wherein the one or more heat fins comprise a plurality of heat fins, with individual heat fins of the plurality of heat fins comprising parallel planar surfaces, and having rectangular cross sections.

11. A system to increase pressure of a fluid with a compressor assembly, the compressor assembly comprising a first cylinder that forms a first space for compressing a fluid, a first piston housed within the first cylinder, the first piston being configured to reciprocate within the first cylinder so as to compress the fluid within the first space; a second cylinder that forms a second space for compressing the fluid that is separate from the first space; a second piston housed within the second cylinder, the second piston being configured to reciprocate within the second cylinder so as to compress the fluid within the second space; a first crank shaft housing operatively coupled with the first cylinder; a first crank shaft housed within the first crank shaft housing, the first crank shaft being configured to drive the first piston; a second crank shaft housing operatively coupled with the second cylinder a second crank shaft housed within the second crank shaft housing, the second crank shaft being configured to drive the second piston; a motor housing operatively coupled with the first crank shaft housing and the second crank shaft housing; a motor housed within the motor housing, the motor being configured to drive the first crank shaft and the second crank shaft, the system comprising:

means for disposing a pressure conduit between the first cylinder and the second cylinder, and outside of the first crank shaft housing, the second crank shaft housing, and the motor housing, the pressure conduit configured to provide a pathway for conducting the fluid between the first cylinder and the second cylinder, means for disposing a connector between the first cylinder and the second cylinder outside the first crank shaft housing, the second crank shaft housing, and the motor housing, wherein the connector is monolithic and positioned in a location corresponding to a center of gravity of the compressor assembly, wherein the connector comprises one or more heat fins configured to facilitate thermal cooling of the compressor assembly, and wherein the connector is separated from the pressure conduit by the first cylinder and the second cylinder;

means for engaging the first cylinder and the second cylinder with the connector; and means for maintaining the operative couplings between the first cylinder and the first crank shaft housing, the second cylinder and the second crank shaft housing, and the motor housing with the first crank shaft housing and the second crank shaft housing.

12. The system of claim 11, further comprising means for providing a thermally conductive path between the first and second cylinders such that temperatures of the cylinders remain substantially the same.

13. The system of claim 11, further comprising means for conducting heat away from the cylinders, and providing a surface area for convective cooling such that temperatures of the cylinders remain substantially the same.

14. The system of claim 11, further comprising:

means for receiving the fluid from a fluid source;

means for communicating fluid to the space formed by the cylinders;

means for conducting the fluid from the means for receiving to the means for communicating:

means for filtering the fluid being conducted from the means for receiving to the means for communicating; and means for muffling noises generated by fluid in the means for conducting.

15. The system of claim 11, wherein the one or more heat fins comprise a plurality of heat fins, with individual heat fins of the plurality of heat fins comprising parallel planar surfaces, and having a rectangular cross section.

* * * * *